United States Patent [19]

Schraven et al.

[11] Patent Number: 4,840,831

[45] Date of Patent: Jun. 20, 1989

[54] PACKING MATERIAL FOR RELATIVELY RIGID OBJECTS AND METHOD FOR PACKING ELECTRODES

[75] Inventors: Petrus E. G. Schraven, Wijchen; Jan A. M. H. Jacobs, DB Druten, both of Netherlands

[73] Assignee: Smitweld B.V., Netherlands

[21] Appl. No.: 40,958

[22] Filed: Apr. 21, 1987

[30] Foreign Application Priority Data

Apr. 29, 1986 [NL] Netherlands ..... 8601090

[51] Int. Cl.[4] ..... B32B 15/08; B32B 15/12; B32B 29/00

[52] U.S. Cl. ..... 428/152; 428/153; 428/336; 428/461; 428/464; 428/537.5

[58] Field of Search ..... 428/461, 153, 537.7, 428/154, 152, 336, 537.5, 464; 206/210

[56] References Cited

U.S. PATENT DOCUMENTS

| | | | |
|---|---|---|---|
| 4,064,302 | 12/1977 | Kozlowski et al. | 428/152 |
| 4,437,567 | 3/1984 | Jeng | 206/210 |
| 4,487,796 | 12/1984 | Lloyd et al. | 428/154 |
| 4,708,896 | 11/1987 | Akao | 428/537.7 X |

FOREIGN PATENT DOCUMENTS

| | | |
|---|---|---|
| 0109465 | 5/1984 | European Pat. Off. . |
| 1263217 | 2/1972 | United Kingdom . |

*Primary Examiner*—Thomas J. Herbert
*Attorney, Agent, or Firm*—Skjerven, Morrill, MacPherson, Franklin & Friel

[57] ABSTRACT

Packaging material for relatively rigid objects, the material consisting of a metal foil sheet coated on one face of the foil sheet with a layer of plastic material, where a creped basic layer of a plastic material or paper is applied to a second face of the foil sheet.

4 Claims, 1 Drawing Sheet

PACKING MATERIAL FOR RELATIVELY RIGID OBJECTS AND METHOD FOR PACKING ELECTRODES

FIELD OF THE INVENTION

The invention relates to a packaging material for relatively rigid objects and further to a method for packing electrodes by supplying such a packaging material in two layers, adhering to each other, to a packing unit.

BACKGROUND OF THE INVENTION

A package for sterile objects, which are used by a surgeon, is known from U.S. Pat. No. 4,437,567. It is stated therein that the package may be made of conventional materials such as a plastic coated metal, glass, plastic film or sheet, plastic coated metal foil or metallized paper or other packaging material impervious to liquid and inert to contents of the package. From British Pat. No. 1,263,217 a packaging material is known for packaging sutures which may be used in surgery, whereby it is important that the sutures prepared from polyglycolic acid are packed in dry conditions and that during storage no moisture penetrates into the package; such moisture would attack the suture of polyglycolic acid and strongly reduce its usability.

The invention is especially directed to finding a packaging material for electrodes whereby the packaging material can also be used to package welding flux, welding wires and backing-up strips or other comparable objects.

Electrodes which do not have to meet special requirements are packed in cardboard boxes, as is available on the market, whilst electrodes which need to be stored under dry circumstances are packed in hermetically sealed cans. Therefore, the invention especially relates to a packaging material to package electrodes which up to now were stored in tins, said electrodes being of a type such as described in the British patent application No. 2,070,976, titled: "Process for production of a low hydrogen type covered arc-electrode".

Low hydrogen covered electrodes are used for welding operations where high standards are set for the welding material in welded joints in structural steel kinds such as Fe E355 or Fe E450, such as are used in, for example, offshore oil and gas producing platforms. One of the standards to be met thereby is that the electrode to be used has a low moisture content, preferably a moisture content so low that the quantity of hydrogen in the welding metal is less than 5 ml per 100 g of melted down welding metal. Customary instructions in connection with thick-walled, rigid constructions require the redrying of coated electrodes at a temperature of 300°–400° C. when the electrodes are supplied in a package which is not completely moisture-proof. Further, it is necessary for coated electrodes to be stored in a dry atmosphere after the redrying treatment, which can be achieved, for example, in warm storage cabinets or tubes at a temperature of about 75°–150° C. It cannot be assumed that these instructions are carried out completely and accurately. These operations also cause important substantial labour expenses. The absorption of moisture by coated electrodes before welding of the electrodes may lead to an undesired high level of diffusable hydrogen, as a result of which the risk of cracks initiated by hydrogen is present in the heavy and rigid steel constructions mentioned above.

A moisture-proof package which has been used so far in this field is a hermetically sealed can, but such a package of tinplate usually contains about 25 kg of electrodes; this corresponds to 400–500 electrodes, which cannot be processed within a time span of 4 hours by a welder. Therefore, it is necessary for the electrodes from such a can to be stored in the above-mentioned warm storage cabinets or tubes when the can has been open longer than 4 hours.

Efforts have been made, therefore, to find a material for a package unit which contains such a number of electrodes as a welder will use within four hours, and the package covers the electrodes and maintains the low moisture content the electrodes originally have in the unopened package. During long storage in the package the moisture content of the packed electrodes should not increase. This will do away with drying and warm storage before use of the electrodes if the electrodes are used within a few hours, viz. within about 4 hours after the package has been opened.

Another problem which occurs when electrodes and the like are packed in a package which must contain relatively heavy electrodes is the mechanical strength of the packaging material that provides moisture-proof storage. These requirements with regard to the mechanical strength are of no influence or play hardly any role with the packaging material which is described in British Pat. No. 1,263,217 in which a packaging material is disclosed to package sutures moisture-proof.

SUMMARY OF THE INVENTION

This problem is now solved with a packaging material according to the invention; said packaging material is characterized in that an aluminum foil is applied on a creped basic layer of a plastic material or paper, said foil being provided with a protective layer.

From the British patent specification it is known that aluminum foil is water-impermeable, but the mechanical strength in the packaging material according to the invention is obtained by applying such an aluminum foil on a creped basic layer; the packaging material has a relatively high deformability in the longitudinal direction and is for this reason not easily damaged. It also is important that the aluminum foil does not directly contact the electrodes, because the aluminum foil would be quickly damaged by the irregular structure of the electrodes. According to the invention, therefore, the aluminum foil is protected by the basic layer at the inside and by a protective layer, such as a plastic material, at the outside.

Very thin aluminum foil already provides sufficient moisture-impermeable action, but the thinner the foil the larger the chance of "pin-holes" being present in the foil. Therefore, it is preferable to process two relatively thin aluminum foils into the packaging material, so that the chance of two "pin-holes" being located on each other is neglectably small.

Because of the elastic properties of the present packaging material there will be no cracks in the aluminum foil, not even at those places which are most sensitive to the formation of such cracks, viz. the edges in the package where the outer ends of the electrodes are in contact with the package.

The creped basic layer may be produced from a plastic material such as polyethylene or polypropylene, which may then be coated with an aluminum foil (not part of the creped basic layer itself) by gluing or the like. However, because the production of a creped layer of a plastic material is somewhat problematic, it is preferable to apply the aluminum foil on crepe paper, which in turn is coated with a plastic layer, such as a layer of polyethylene or polypropylene.

DESCRIPTION OF THE INVENTION

In the following description it is assumed that creped paper is used for the basic layer and polyethylene for the plastic material.

With reference to a packaging material with a core of crepe paper the crepe paper is provided on both sides with an adhesive layer of polyethylene coated with an aluminum foil on both sides. On the inside, the aluminum foil is covered with polyethylene so that the electrodes cannot damage the aluminum foil and is also provided with a further polyethylene layer with which the package can be sealed or closed. On the outside of the package, the aluminum foil is provided with a protective layer so that the package is resistant against undesired mechanical influences from outside.

BRIEF DESCRIPTION OF THE DRAWING

The FIGURE diagrammatically illustrates a packaging according to the invention, with one electrode shown within the package.

In the FIGURE, reference number 1 indicates the package and 2 indicates the electrode, which electrode has a holder end 3 and a starting head 4. The package also has a sealed seam 5 and a tear-open notch 6 on the package. As used herein the phrase "area density," applied to a sheet of material of predetermined thickness, indicates the mass per unit area (e.g., expressed in units of grams per square meter) of the sheet.

Figure 1:
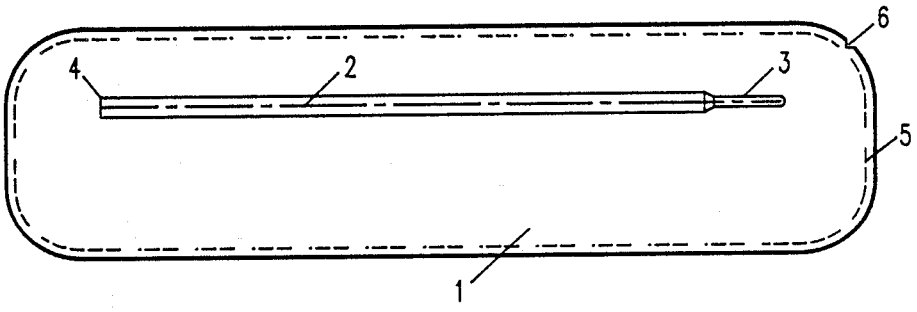

A preferred embodiment of the packaging material is built up from the inside to the outside from:

90–110 g/m$^2$ (area density) sealing film of polyethylene,

100–120 g/m$^2$ protecting layer of polyethylene,

50–60 g/m$^2$ aluminum foil,

40–50 g/m$^2$ adhesive or protecting layer of polyethylene,

60–80 g/m$^2$ creped paper with 40% stretch (40% creping),

30–50 g/m$^2$ adhesive or protecting layer of polyethylene,

20–25 g/m$^2$ aluminum foil,

20–25 g/m$^2$ protective layer of polyethylene and

20 μm thickness transparent polyethylene film.

In one an example according to the invention the package according to the invention is built up from:

a sealing film of polyethylene with a thickess of about 110 μm of area density 90 g/m$^2$; for this purpose polyethylene with a low density may be used with 5 weight percent of vinylacetate (melting index according to ASTM D 1238 of 5.5 g/10 minutes and a volume density according to ASTM D 1505 of 0.922 g/cm$^3$);

a protecting layer of polyethylene having a thickness of about 115 μm of area density 100 g/m$^2$; as such a foil one can use low density polyethylene such as having a melting index according to ASTM D 1238 of 8 g/10 minutes and a volume density according to ASTM D 1505 of 0.915 g/cm$^3$;

an aluminum foil with a thickness of 20 μm of area density 55 g/cm$^3$;

a coating of polyethylene with a thickness of 50 μm of area density 45 g/cm$^3$;

a layer of crepe paper of area density 60 g/m$^2$ with 40 percent total stretch;

a coating on the basis of polyethylene with a thickness of 50 μm of area density 40 g/cm$^3$;

an aluminum foil with a thickness of 11–13 μm of area density 22 g/cm$^3$ and a protective layer or coating of polyethylene being 20 μm of area density 20 g/m$^2$, and, if desired, a further transparent polyethylene film being 20 μm thick.

The purpose of the inner layers of polyethylene with a total thickness of about 225 μm is to protect the aluminum foil from the comparatively rough surface of the electrodes so that the aluminum foil is not perforated.

In the method according to the invention for packaging electrodes in a packaging material, the material is supplied to a packing unit as an upper and lower layer, the electrodes are positioned on the lower layer, the upper layer is provided and the upper and the lower layers are adhered together and the package is cut off at package length. The two layers are preferably at first adhered together in a limited number of spots to maintain their form and a vacuum is generated. The package is preferably sealed and the sealed seam is cooled. Subsequently the package is cut off at package length. In particular the upper and lower layers are stressed and pre-formed in a pre-heated die so that electrodes can be provided to fit therein. The electrodes typically have a length of 350–450 mm and a core diameter of 2.5–6 mm, around which a ceramic mass with a diameter of 4–13 mm is provided, and are maintained at a temperature of about 40° C. before being packed. Especially, the starting heads of the electrodes must be protected from shocks. Before packing the packaging material is supplied from reels, viz. one reel for supplying the upper layer and one reel for supplying the lower layer. During unwinding of the packaging material, both the lower layer and the upper layers are kept under tension, which tension is also maintained when the sheets of the packaging material are not moving. During the stationary position the upper and lower layers are pre-formed in a heated die. The pre-formed upper and lower layers together can be formed into a tube with a height varying from 7 to 25 mm, dependent on the number of layers and the thickness of the electrodes being packed. By means of pusher rolls the upper and lower layers are brought together after the electrodes have been provided on the lower layer. As soon as the upper and lower layers are in contact with each other they are spot-sealed on several spots so that the form of the tube is maintained. The ends of that tube are pressed flat and the tube is placed in a vacuum cabinet in which a vacuum of 60–90 percent of one atmosphere is generated so that in the vacuum cabinet there is a pressure of 0.1–0.4 atmosphere. In the vacuum cabinet the tube is completely sealed and the sealed seam is cooled, or the upper and lower layers are adhered together in a different manner. Subsequently the tube is removed from the vacuum cabinet and cut off at package length so that a package with electrodes according to the invention has been obtained. The sealed seam is obtained as a continuous seam without overlapping, so that the best possible connection of the upper layer to the lower layer is obtained. Sealing or adhering takes place by heating the layers of the packaging material at the outside of the package, whereby within a time of about 4 seconds a temperature of about 180° C. is obtained, dependent on the composition of the polyethylene comprising adhesive layer. During sealing the lower layer and the upper layer are pressed together at the outer adge.

In such a tube preferably 1–5 layers of electrodes may be provided above one another; such a package usually has a weight of about 1–4 kg. It will of course also be possible to pack one single electrode in this way; such a packed electrode will fall within the scope of the present invention as long as a packaging material is used as recited in the following claims, or that a method is used as recited in the claims.

When using the packed electrodes according to the invention it will be possible to check whether the package still meets the requirements; in other words, whether the electrodes still meet the requirements of "freshness" because before using the package it can be checked whether or not there is still a sub-atmospheric pressure inside the package. As long as there is still a sub-atmospheric pressure, it will be obvious that no leakage has occured.

We claim:

1. Packaging material for relatively rigid objects, the packaging material comprising:

a creped basic layer of paper or plastic having a stretch capability of substantially 20–80 percent;

a first sheet of metal foil positioned adjacent to one face of the creped basic layer;

a first polyethylene-based adhesive layer positioned between and contiguous to the creped basic layer and the first sheet of metal foil;

a second sheet of metal foil positioned adjacent to a second face of the creped basic layer;

a second polyethylene-based adhesive layer positioned between and contiguous to the creped basic layer and the second metal foil;

a first layer of polyethylene plastic material positioned contiguous to the first metal foil sheet so that the first metal foil sheet lies between the first layer of plastic material and the first adhesive layer; and a second layer of polyethylene plastic material positioned contiguous to the second metal foil sheet so that the second metal foil sheet lies between the second layer of plastic material and the second adhesive layer.

2. Packaging material for relatively rigid objects, the packaging material comprising:

a creped basic layer of paper having a stretch capability of substantially 20–80 percent and an area density of substantially 60–80 gm/m$^2$;

a first sheet of metal foil with an area density of substantially 50–60 gm/m$^2$ positioned adjacent to one face of the creped basic layer;

a first polyethylene-based adhesive layer having an area density of substantially 40–50 gm/m$^2$ positioned between and contiguous to each of the creped basic layer and the first sheet of metal foil;

a second sheet of metal foil having an area density of substantially 20–25 gm/m$^2$ positioned adjacent to a second face of the creped basic layer;

a second polyethylene-based adhesive layer having an area density of substantially 30–50 gm/m$^2$ positioned between and contiguous to each of the creped basic layer and the second metal foil;

a first layer of polyethylene plastic material having an area density of substantially 100–120 gm/m$^2$ positioned contiguous to the first metal foil sheet so that the first metal foil sheet lies between and is contiguous to the first layer of plastic material and the first adhesive layer;

a second layer of polyethylene plastic material having an area density of substantially 20–25 gm/m$^2$ and being positioned contiguous to the second metal foil sheet so that the second metal foil sheet lies between the second layer of plastic material and the second adhesive layer; and a third layer of polyethylene plastic material having an area density of substantially 90–100 gm/m$^2$ and being positioned contiguous to the first layer of plastic material so that the first layer of polyethylene lies between the third layer of polyethylene and the first metal foil.

3. Packaging material according claim 2, further comprising a fourth layer of a plastic material positioned contiguous to said second layer of plastic material so that said second layer of polyethylene lies between the fourth layer of plastic material and said second sheet of metal foil.

4. Packaging material according to claim 3, wherein said fourth layer of plastic material has thickness substantially 20 $\mu$m.

* * * * *